US011161706B2

(12) United States Patent
Hsieh et al.

(10) Patent No.: US 11,161,706 B2
(45) Date of Patent: Nov. 2, 2021

(54) PICK UP DEVICE FOR USING IN AUTOMATIC FEEDER

(71) Applicant: Foxlink Image Technology Co., Ltd., New Taipei (TW)

(72) Inventors: Wei Pin Hsieh, New Taipei (TW); Yung Kai Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 201 days.

(21) Appl. No.: 16/593,083

(22) Filed: Oct. 4, 2019

(65) Prior Publication Data

US 2021/0024310 A1 Jan. 28, 2021

(30) Foreign Application Priority Data

Jul. 22, 2019 (TW) ..... 108209539

(51) Int. Cl.
*B65H 3/06* (2006.01)
*B65H 3/34* (2006.01)
*B65H 3/50* (2006.01)

(52) U.S. Cl.
CPC ..... *B65H 3/50* (2013.01); *B65H 3/063* (2013.01); *B65H 3/34* (2013.01); *B65H 2404/7414* (2013.01)

(58) Field of Classification Search
CPC ..... B65H 3/063; B65H 3/5284; B65H 3/66; B65H 3/34
See application file for complete search history.

(56) References Cited

U.S. PATENT DOCUMENTS

| | | | | |
|---|---|---|---|---|
| 9,242,815 | B2 * | 1/2016 | Okumura | B65H 3/0653 |
| 10,099,874 | B2 * | 10/2018 | Kuriki | B65H 3/5238 |
| 10,246,281 | B2 * | 4/2019 | Kuriki | B65H 3/0669 |

* cited by examiner

*Primary Examiner* — Patrick Cicchino
(74) *Attorney, Agent, or Firm* — Lin & Associates Intellectual Property, Inc.

(57) ABSTRACT

A pick-up device disposed between an input tray and a feeding path includes a paper feeding unit for feeding paper, a separation roller disposed opposite to the paper feeding unit, a blocking arm disposed between the input tray and the paper feeding unit and configured to be switchably disposed between a blocking position for blocking the paper and a feeding position for passing the paper through the feeding path, and a guiding arm disposed in the feeding path through a pivot shaft and having a guiding portion. The pivot shaft is located upstream of the separation roller, and the guiding portion is swingably disposed in a seam space formed by the paper feeding unit and the separation roller.

3 Claims, 4 Drawing Sheets

PICK UP DEVICE FOR USING IN AUTOMATIC FEEDER

CROSS-REFERENCE TO RELATED APPLICATION

The present application is based on, and claims priority from, Taiwan Patent Application No. 108209539, filed Jul. 22, 2019, the disclosure of which is hereby incorporated by reference herein in its entirety.

BACKGROUND OF THE INVENTION

1. Field of the Invention

This invention relates to a pick-up device, in particular to a pick-up device which is able to avoid paper damage caused by paper warpage.

2. The Related Art

Referring to FIG. 1, a pick-up device is placed at the entrance of the automatic document feeder for separating the stacked paper and feeding the paper one by one into the feeding path. In order to avoid multi-feeding the paper, the pick-up device includes a feeding path, a pick-up roller 20' that picks the paper up and feeds the paper into the feeding path, a separation roller 30' located in the feeding path to provide friction to the paper for separating the overlapped paper, and a blocking device 40' moveable disposed between the pick-up roller 20' and the separation roller 30' for preventing the paper from entering the feeding path in the wrong timing.

However, the paper may be warpage during the feeding process and end up in paper damage eventually, and the conventional pick-up device cannot prevent the paper being damaged. Some of the most common conditions that causes the warpage of the paper are shown in FIG. 2 to FIG. 4.

In FIG. 2, the upper paper is free to fall when the lower paper is fed into the feeding path, and during that falling, the leading edge of the upper paper would contact with the roller and be warpage.

FIG. 3 shows another condition, the separation roller 30' rotates in the reverse direction that feeds the paper back to the input tray for separating the multifid-paper back. Therefore, when the leading end of the paper contacts with the separation roller 30', it is very likely to be warped by the separation roller 30'.

The feed roller can also cause warpage sometimes. In FIG. 4, the separation roller 30' is made of elastic material to improve the feeding force applied to the paper, so the roller would be deformed under the pulling of the paper during the feeding process. When the paper leaves the roller, the roller would rebound back, and cause the following paper warpage with a chance.

Therefore, it is necessary to provide a pick-up device which is able to guide paper and avoid paper damage caused by paper warpage.

SUMMARY OF THE INVENTION

To achieve said objective, the present invention discloses a pick-up device disposed between the input tray and the feeding path and includes: a paper feeding unit for picking up paper from the input tray; a separation roller disposed opposite to the paper feeding unit and contacted with said paper feeding unit; a blocking arm disposed between the input tray and the paper feeding unit and configured to switch between a blocking position for blocking the paper and a feeding position for passing the paper through the feeding path; and a guiding arm pivotally arranged in the feeding path via a pivot shaft disposed upstream to the separation roller, and the guiding arm is provided with a guiding portion which is swingably disposed in a seam space formed by the paper feeding unit and the separation roller; wherein the distance from the axle of the separation roller to the guiding portion is greater than the radius of the separation roller, and the vertical distance between the paper to be fed and the guiding portion is greater than the vertical distance between the paper to be fed and the separation roller.

In a preferred embodiment, the guiding arm includes a lifting portion arranged upstream to the guiding portion in the paper feed direction.

In a preferred embodiment, the lifting portion is arranged downstream to the blocking arm in the paper feeding direction.

In a preferred embodiment, the guiding arm includes a blocking portion arranged upstream to the lifting portion in the paper feed direction.

In a preferred embodiment, the blocking portion includes a vertex arranged upstream to the blocking portion in the paper feeding direction, and the distance from the paper to the vertex is greater than the distance from the bottom end of the blocking arm to the paper.

In a preferred embodiment, the angle between the guiding portion and the feeding path is smaller than the angle between the lifting portion and the feeding path, and the angle between the lifting portion and the feeding path is smaller than the angle between the blocking portion and the feeding path when viewed from an axial direction of the separation roller.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

In order to describe the technical contents, structural features, purpose to be achieved and the effectiveness of the present invention, the detailed description is given with schema below.

Figure 1:
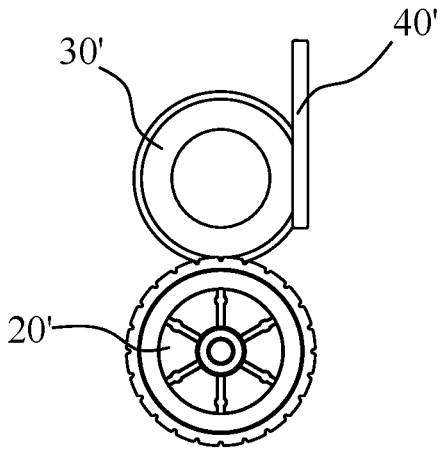
FIG. 1 is a side view of a conventional pick-up device.
Figure 2:
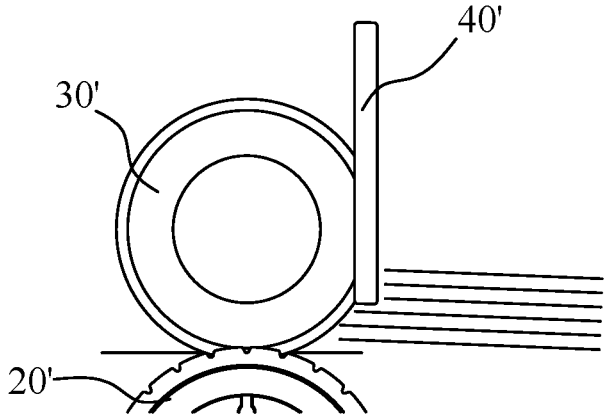
FIG. 2 is a schematic diagram showing the warpage caused by the falling of the paper in the conventional pick-up device.
Figure 3:
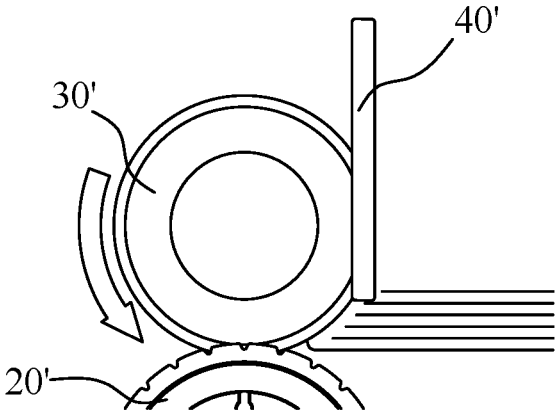
FIG. 3 is a schematic diagram showing the warpage caused by the reversal of the separation roller in the conventional pick-up device.
Figure 4:
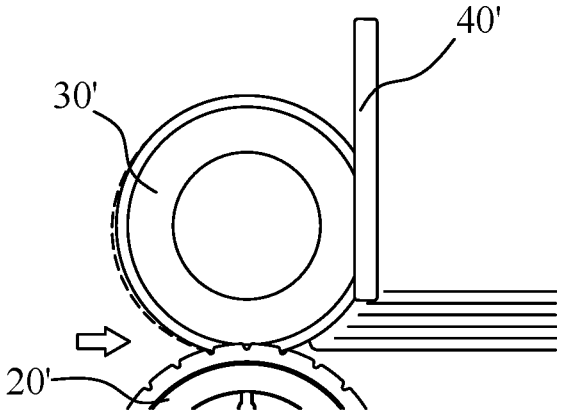
FIG. 4 is a schematic diagram showing the warpage caused by the rebound of the separation roller in the conventional pick-up device.
Figure 5A:
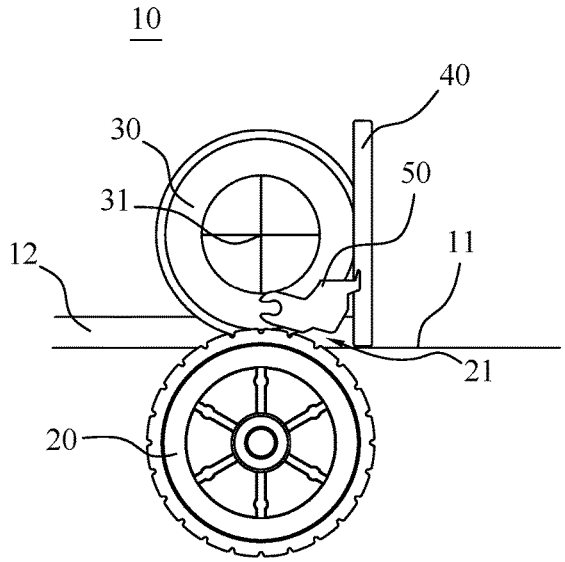
FIG. 5A is a side view of a pick-up device of the present invention.
Figure 5B:
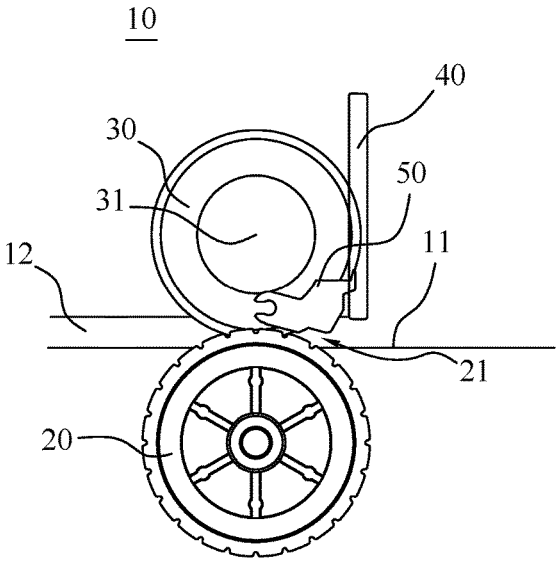
FIG. 5B is a side view of a lifted blocking arm in the present creation.

Referring to FIGS. 5A and 5B, the pick-up device 10 of the present invention is disposed between an input tray 11 and a feeding path 12 for feeding the paper stacked in the input tray 11 into the feeding path 12. The pick-up device 10 includes the following components which are disposed from the upstream to the downstream of the feeding path 12: a blocking arm 40, a guiding arm 50 and a pair of a paper feeding unit 20 and a separation roller 30 which is disposed on the opposite sides of the feeding path 12. For convenience of explanation, the terms "upstream" and "downstream" as used hereinafter refers to the direction in which the paper is fed from and the direction in which the paper is fed toward.

The blocking arm 40 is movably disposed in the feeding path 12 and able to switch between a blocking position for blocking the paper and a feeding position for passing the paper through the feeding path 12. The guiding arm 50 is pivotally connected in the feeding path 12 via a pivot shaft 14 located upstream to the separation roller 30 for guiding the paper to smoothly contact with the paper feeding unit 20 thereby.

Figure 6:
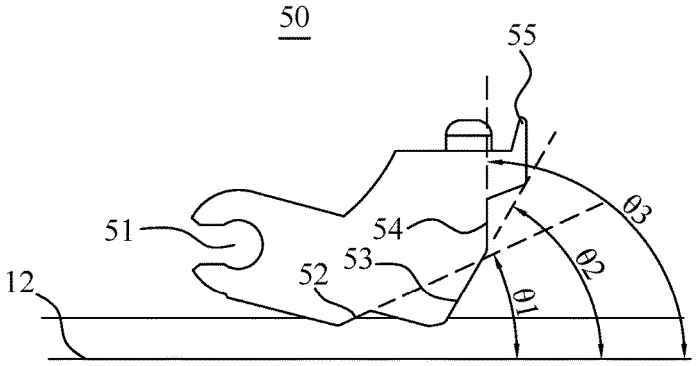
FIG. 6 is a side view of a guiding arm.

Referring to FIG. 5A and FIG. 6, the guiding arm 50 includes a guiding portion 52, a lifting portion 53 arranged upstream to the guiding portion 52 in the paper feed direction, a blocking portion 54 arranged upstream to the lifting portion 53 in the paper feed direction, and a vertex 55 arranged upstream to the blocking portion 54 in the paper feed direction.

Figure 9A:
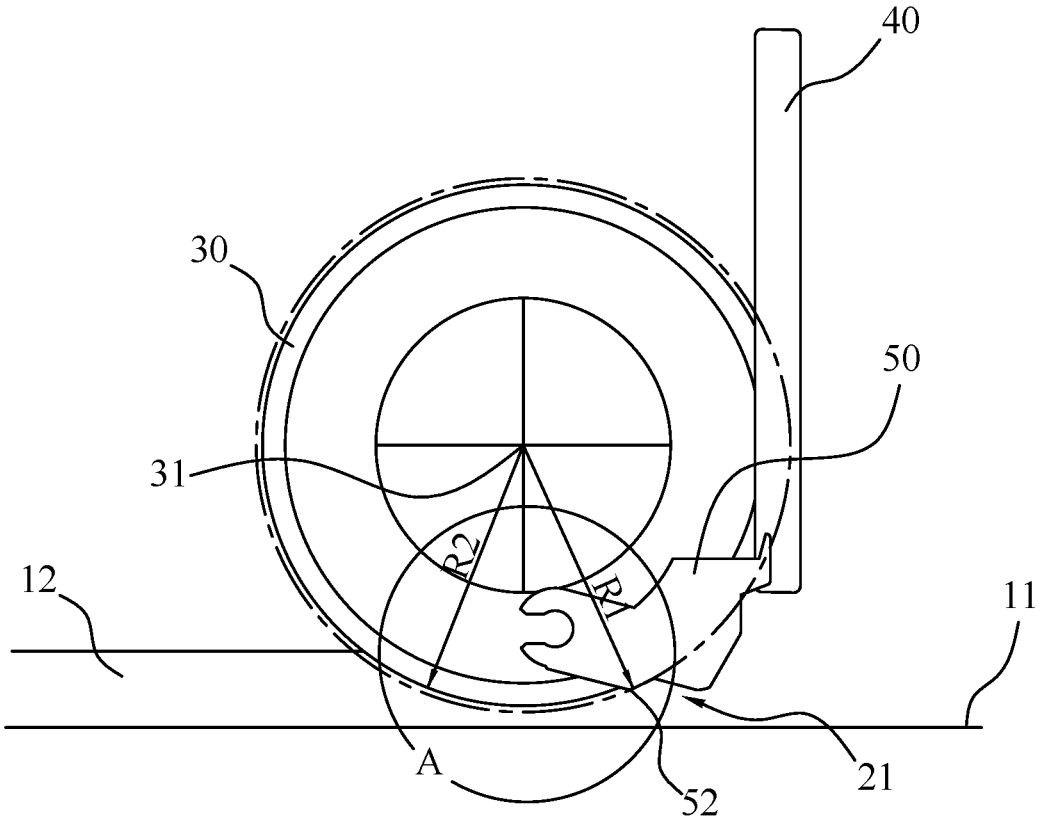
FIG. 9A is a side view of the guiding arm and a separation roller in the present invention.
Figure 9B:
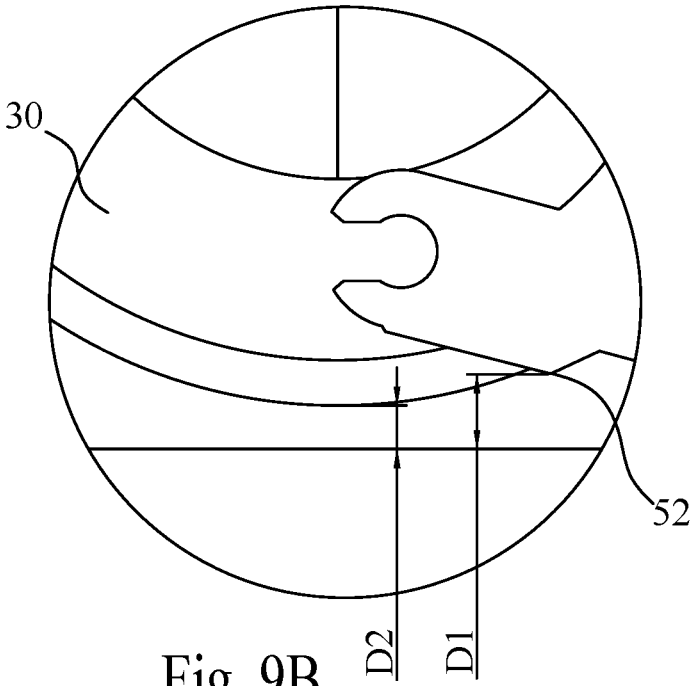
FIG. 9B is an enlarged view of part A of FIG. 9A.

Referring to FIG. 6, FIG. 9A and FIG. 9B , the guiding portion 52 is swingably disposed in a seam space 21 formed by the paper feeding unit 20 and the separation roller 30-, and formed a slight angle θ1 with the feeding path 12 for guiding the paper to smoothly contact with the paper feeding unit 20. In order to ensure the paper to contact with the paper feeding unit 20 smoothly, the distance R1 from the axle 31 of the separation roller 30 to the guiding portion 52 is larger than the radius R2 of the separation roller 30, and the vertical distance D1 from the paper to be fed to the guiding portion 52 is greater than the vertical distance D2 from the paper to be fed to the separation roller 30.

The lifting portion 53 is disposed downstream to the blocking arm 40 in the paper feeding direction, and forms an angle θ2 with the feeding path 12. The angle θ2 is greater than the angle θ1, so that more normal force is applied to the lifting portion 53 when the paper to be fed passes through the blocking arm 40 and comes in contact with the lifting portion 53, and thus generates a moment that pushes the guiding arm 50 away from the feeding path 12.

Figure 7:
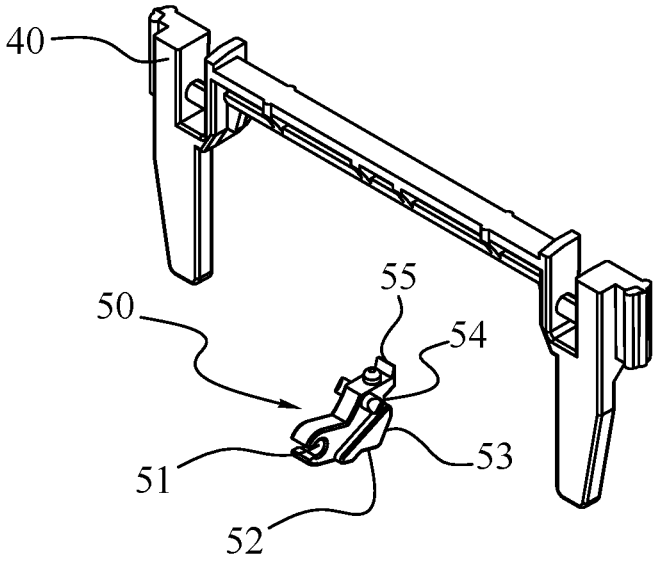
FIG. 7 is a perspective view of the guiding arm and the blocking arm.

Referring FIG. 6 and FIG. 7, the blocking portion 54 is substantially coincided with the blocking arm 40 during the feeding process, and the angle θ3 formed by the blocking portion 54 and the feeding path 12 is larger than the angle θ2 formed by the lifting portion 53 and the feeding path 12. Further, the distance between the vertex 55 and the paper is greater than the distance between the bottom end of the blocking arm 40 and the paper. Therefore, it prevents the paper to be fed from contacting with the separation roller 30 too early during the feeding process, and not contacting with the lifting portion 53 and the guiding portion 52 in sequence due to the gap appeared between the guiding arm 30 and the blocking arm 40.

Figure 8:
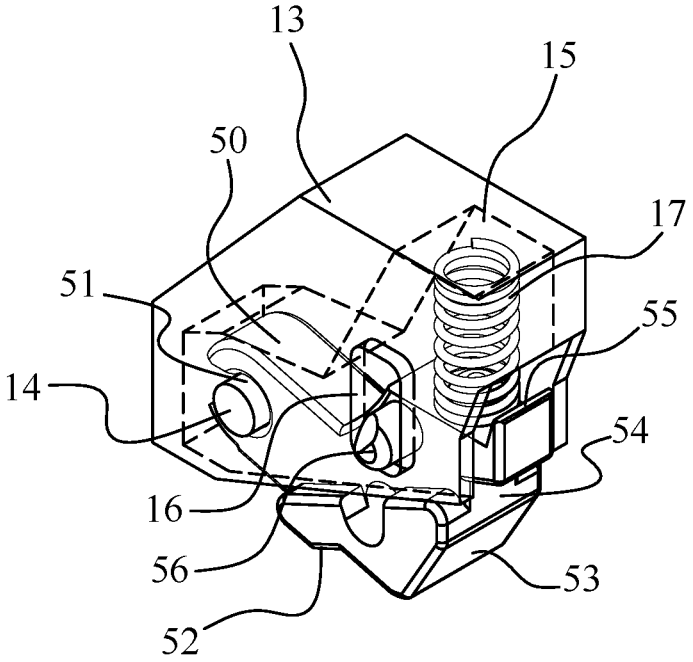
FIG. 8 is a perspective view of the guiding arm.

Referring to FIG. 8, in a preferred embodiment of the present invention, the guiding arm 50 is arranged on an upper wall 13 of the feeding path 12, and the upper wall 13 is provided with a containing space 15 for containing a pivot shaft 14, a guiding slot 16 arranged upstream to the pivot shaft 14, and an elastomer 17 for pushing the guiding arm 50. The guiding arm 50 includes a pivot hole 51 which is arranged to engage with the pivot shaft 14, and a guiding block 56 disposed on a side of the guiding arm 50 to engage the guiding slot 16. The swinging amplitude of the guiding arm 50 is restricted by the engagement of the guiding slot 16 and the guiding block 56. And the guiding arm 50 in forced to contact with the paper to be fed by the abutment of the elastomer 17.

What is claimed is:

1. A pick-up device being disposed between an input tray and a feeding path of an automatic feeder and comprising:

a paper feeding unit for picking up paper from the input tray;

a separation roller disposed opposite to the paper feeding unit and contacted with the paper feeding unit;

a blocking arm disposed between the input tray and the paper feeding unit and configured to switch between a blocking position for blocking the paper and a feeding position for passing the paper through the feeding path; and a guiding arm pivotally arranged in the feeding path via a pivot shaft disposed upstream to the separation roller, the guiding arm having guiding portion, a lifting portion and a blocking portion, the guiding portion being swingably disposed in a seam space formed by the paper feeding unit and the separation roller, the lifting portion being arranged upstream to the guiding portion in a paper feed direction, and the blocking portion being arranged upstream to the lifting portion in the paper feed direction;

wherein a distance from an axle of the separation roller to the guiding portion is greater than a radius of the separation roller, a vertical distance between the paper to be fed and the guiding portion is greater than a vertical distance between the paper to be fed and the separation roller, an angle between the guiding portion and the feeding path is smaller than an angle between the lifting portion and the feeding path, and the angle between the lifting portion and the feeding path is smaller than an angle between the blocking portion and the feeding path when viewed from an axial direction of the separation roller.

2. The pick-up device as claimed in claim 1, wherein the lifting portion is arranged downstream to the blocking arm in the paper feeding direction.

3. The pick-up device as claimed in claim 1, wherein the guiding arm has a vertex arranged upstream to the blocking portion in the paper feeding direction, and a distance from the paper to the vertex is greater than a distance from a bottom end of the blocking arm to the paper.

* * * * *